United States Patent [19]

Wilson

[11] Patent Number: 5,072,876

[45] Date of Patent: Dec. 17, 1991

[54] ARTICLE CARRIER WITH SIDE HANDLES

[75] Inventor: Jerry F. Wilson, Downsville, La.

[73] Assignee: Riverwood International Corporation, Denver, Colo.

[21] Appl. No.: 605,610

[22] Filed: Oct. 30, 1990

[51] Int. Cl.[5] ..... B65D 5/02

[52] U.S. Cl. ..... 229/40; 229/117.16; 206/427

[58] Field of Search ..... 229/40, 117.16, 121; 206/427

[56] References Cited

U.S. PATENT DOCUMENTS

| | | | |
|---|---|---|---|
| 2,111,376 | 3/1938 | Van Wingen | 229/117.16 |
| 3,904,036 | 9/1975 | Forrer | 206/427 |
| 4,029,207 | 6/1977 | Gordon | 229/117.12 |
| 4,042,165 | 8/1977 | Elder | 229/117.16 |
| 4,295,598 | 10/1981 | Calvert | 229/117.24 |
| 4,588,084 | 5/1986 | Holley, Jr. | 229/40 |
| 4,817,861 | 4/1989 | Henrikson | 229/117.16 |
| 4,830,267 | 5/1989 | Wilson | 206/427 |

*Primary Examiner*—Stephen Marcus
*Assistant Examiner*—Christopher McDonald
*Attorney, Agent, or Firm*—John D. Lister; Cornelius P. Quinn

[57] ABSTRACT

An article carrier having handle openings in the end panels. Handle openings are provided in end panel flaps connected to the top panel. The end panel flaps overlie a second layer of material also containing handle openings so that the handle openings in the end panel flaps are aligned with the handle openings in the second layer, thus providing handle openings of double thickness. The second layer may be a flap connected to an inner top panel layer underlying the top panel or it may comprise end panel flaps connected to the side panels.

5 Claims, 3 Drawing Sheets

ARTICLE CARRIER WITH SIDE HANDLES

FIELD OF THE INVENTION

This invention relates to article carriers. More particularly, it relates to a handle for lifting and carrying enclosed article carriers.

BACKGROUND OF THE INVENTION

Article carriers normally include an opening or other form of handle to enable the carrier to be readily lifted. The type of handle will necessarily vary depending on the type of carrier involved. The handle for a package of beverage cans, for example, will be different than a handle for a package of bottles.

Of particular difficulty is the problem of designing a suitable handle for certain types of fully enclosed carriers, such as a carrier designed to carry long-necked beer bottles. A typical carrier of this type has inwardly sloped end panels which generally follow the contour of the bottles, and tear-away portions extending from the side panels into the top panels to facilitate opening the package. In such an arrangement the common suitcase type of handle, consisting of spaced elongated openings in the top panel separated by a narrow strap by which a user lifts the carrier, is sometimes subject to tearing due to the inability of the top panel to resist the lifting stresses at the ends of the straps or the handle openings. Attempts have been made to improve the handle design by providing handle openings in the end panels, as disclosed in U.S. Pat. No. 4,295,598. Although the arrangement disclosed in the patent provides for the lifting stresses to be directed primarily at the upper edge of the handle openings, which is more able to resist them than the suitcase type of handle, the handles are located in the lower or straight portion of the end panels. This makes for an awkward lifting process and does not provide much room for the fingers, since the wide portions of the end bottles are immediately adjacent the openings. Further, even though the handle is stronger in such an arrangement than the usual type of openings in the top panel, it is often not as strong as desired when relatively thin paperboard is used to form the carrier.

It has also been suggested in U.S. Pat. No. 4,029,207 to provide handle openings in the form of finger holes near the edge of the top panel. In that arrangement an extra fold of paperboard is utilized so as to provide double thickness in the area of the handle. This increases the strength somewhat and prevents the entry of light, which was a prime goal in the design of the handle, but the design still has the disadvantage of requiring the carrier to be lifted by the top panel. In addition, the finger holes are located adjacent the edge of the top panel, thereby increasing the danger of tearing.

A stronger handle is needed for carriers of this type which are not located in the top panel and which do not have the disadvantages of the side handles in the prior art design discussed above.

BRIEF SUMMARY OF THE INVENTION

The invention comprises a carrier, and a blank for forming the same, which comprises top and bottom panels having side edges and end edges, side panels connected to the side edges of the top and bottom panels and end panels connected to the end edges of the top, bottom and side panels. Each end panel comprises an upper end panel flap foldably connected to the associated end edge of the top panel, with the upper end flap containing a handle opening therein. The upper end panel flap overlies an inner end panel flap which also contains a handle opening, so that the handle opening of the upper end panel flap overlies the handle opening of the inner end panel flap.

In one embodiment the inner end panel flap comprises an inner second top panel layer underlying the outer top panel layer to which the upper end panel flap is attached. In another embodiment the inner end panel flap comprises flaps connected to the end edges of the side panels, each flap containing an opening.

When the openings are arranged so that their upper edges are substantially aligned, both layers of material forming the handles are gripped, thereby readily resisting the lifting stresses. By locating the handle openings in the upper portion of the end panels, the handle openings are readily accessible and the space between the openings and the bottle necks is easily sufficient to receive the fingers of a user. This design can be accommodated in a carrier blank formed of a single sheet of material, and existing machines can be used to form the blanks and to form a package from the blanks.

DETAILED DESCRIPTION OF THE PREFERRED EMBODIMENTS

Figure 1:
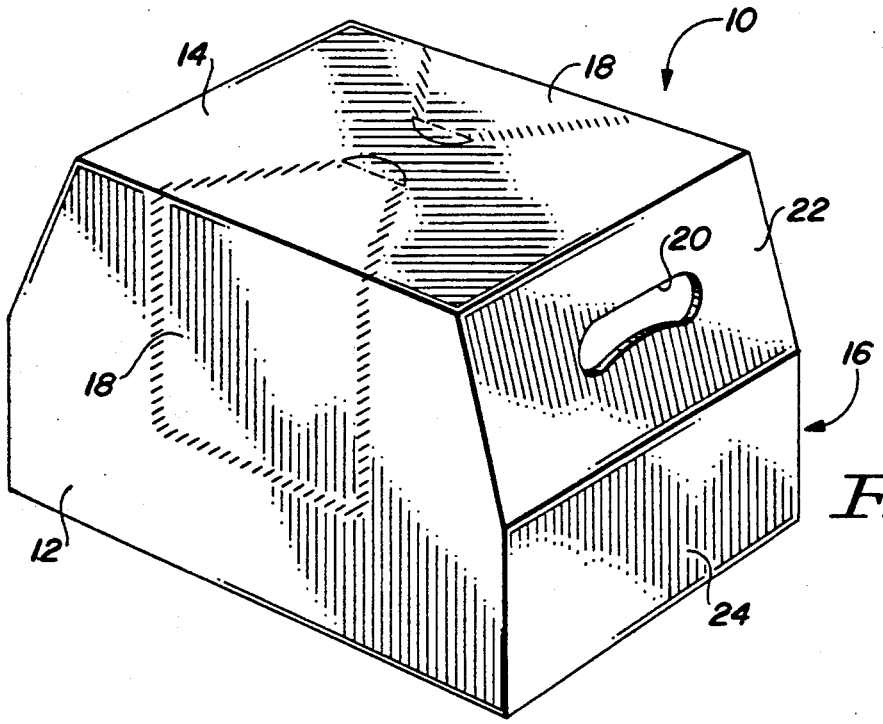
FIG. 1 is a pictorial view of an article carrier incorporating the handle of the invention.

Referring to FIG. 1, an enclosed article carrier 10 is illustrated which comprises side panels 12, a top panel 14 and end panels 16. The top and side panels contain tear-away sections 18 and the end panels 16 contain handle openings 20. The handle openings are shown as being located in the upper end panel flaps 22 which are overlapped by and adhered to lower end panel flaps 24. Although the invention has utility with carriers designed to package a variety of different types of articles, the upper end panel flap 22 is shown to be sloped with respect to the lower end panel flap 24, as it would be in a carrier designed to carry long-necked bottles.

Figure 2:
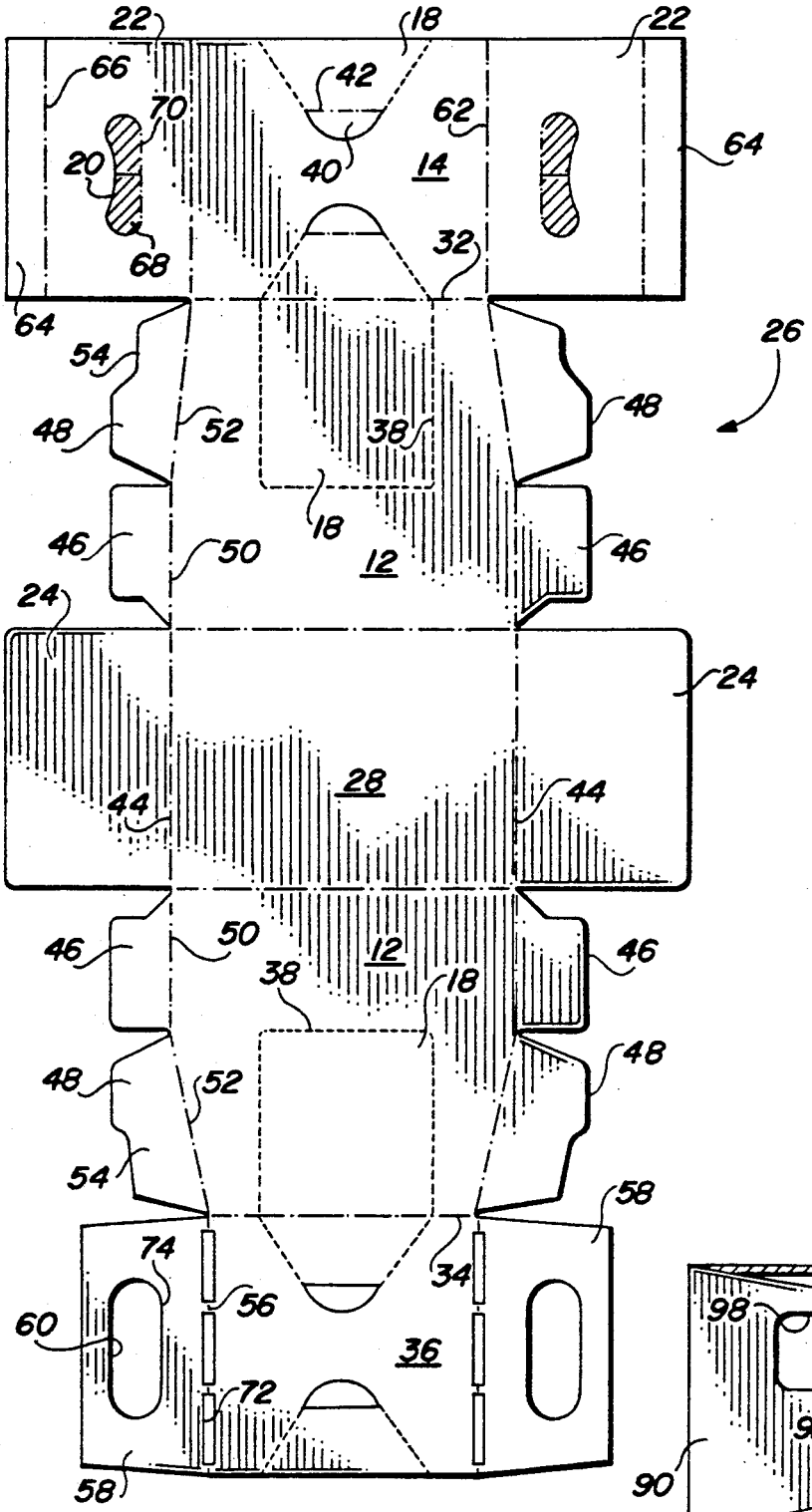
FIG. 2 is a plan view of a production blank for forming a first embodiment of the carrier of the invention.

Referring to FIG. 2, wherein like reference numerals to those of FIG. 1 denote like elements, a blank for forming the carrier 10 is indicated generally by reference numeral 26. The blank is of generally rectangular shape, comprising a central bottom panel section 28 connected to intermediate side panel sections 12 along score lines 30. One intermediate side panel section 12 is connected by score line 32 to outer top panel section 14 while the other intermediate side panel section is connected by score line 34 to inner top panel section 36.

The tear-away sections 18 are defined by weakened lines 38, as is well known in the art, which terminate in the upper panel sections at a flap 40 connected along fold line 42 to enable a user to grasp the end of the tear-away section to remove it.

Lower end panel flaps 24 are connected to the end edges of the bottom panel section 28 by score lines 44, and dust flaps 46 and 48 are connected to the end edges of the side panel sections 12 by score lines 50 and 52. The score line 50 corresponds to the lower end panel flap 24 of the carrier, and the score line 52 corresponds to the sloped upper end panel flap 22. The dust flaps 48 include an outer edge portion 54 corresponding to a narrow part of the dust flaps, which is significant for a reason to be explained later.

Connected to the end edges of the inner top panel section 36 along interrupted fold lines 56 are end panel flaps 58 containing a handle opening 60. Connected to the end edges of the outer top panel section 14 along score lines 62 are the upper end panel flaps 22. A glue strip 64 is connected to each upper end panel flap by a score line 66. The upper end panel flaps 22 also contain handle openings 20 which are covered by flaps 68 connected to the upper edge of the handle opening 20 along fold line 70. The interrupted fold line 56 connecting the flap 58 to the inner top panel 36 preferably includes cutout portions 72 to facilitate folding the flap 58. The handle openings 60 in the flaps 58 are slightly larger than the handle openings 20 in the flaps 22, and the handle openings 60 have an upper edge 74 which is substantially aligned with the upper edge 70 of the handle openings 20.

In practice, to form a carrier sleeve the blank is folded along the lowermost score line 30 in FIG. 2 so that the lowermost edge of the inner top panel section 36, as viewed in FIG. 2, is aligned with the score line 32. The outer top panel section 14 is then folded down to overlie the inner top panel section 36. One or both of the inner and outer top panel sections 36 and 14 would have been coated with adhesive prior to the folding step so that the sections 36 and 14 adhere to each other. The tear lines 38 will overlie each other to enable the tear-away sections 18 of the top and side panels of the carrier to be removed together. The resulting sleeve is introduced in collapsed form to the packaging machine where it is opened and filled with bottles or other articles introduced through the open ends by means well known in the art.

Figure 3:
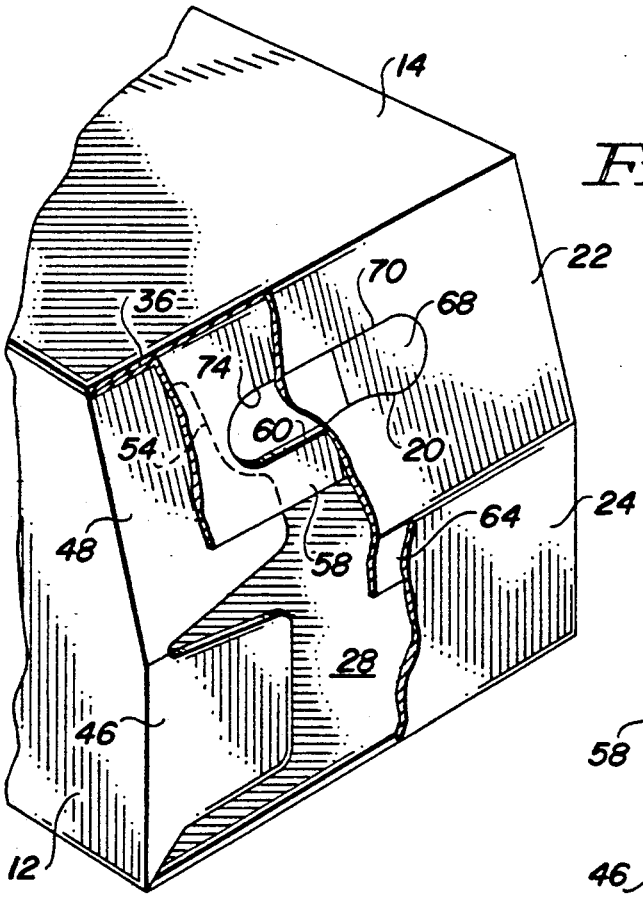
FIG. 3 is an enlarged partial pictorial view of the carrier, with portions of the end flaps cut away to better show the flap arrangement.
Figure 4:
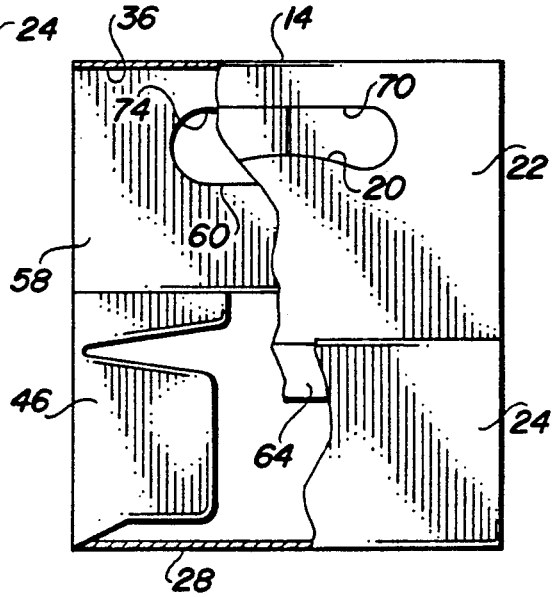
FIG. 4 is an end view of the carrier of FIG. 3, with portions of the end panel structure omitted to better show underlying structure.

After the sleeve is filled with the articles to be packaged, the dust flaps are closed and the upper and lower end flaps are adhered to form the end panels of the carrier. This arrangement is illustrated in FIGS. 3 and 4, wherein the inner end panel flap 58 has been folded down from the inner top panel section 36 across the folded dust flaps 48. Note that the articles in the carrier have been omitted for purpose of clarity. The upper end panel flap 22 has been folded down over the inner end panel flap 58, with the handle opening 20 overlying the handle opening 60. The larger size of the opening 60 ensures that the fingers of a user will be able to enter the opening 60 after having penetrated the opening 20. By locating the handle openings so that their upper edges 70 and 74 are substantially aligned, the fingers of a user will engage both edges when lifting or carrying the carrier, thereby allowing the lifting stresses to be distributed through the edges of the handle openings. It will be understood that the presence of the flap 68 covering the opening 20 does not interfere with the lifting process since the fingers of a user simply fold the flap back under the upper edges of the openings 20 and 60. This provides a cushion to the fingers and prevents the upper edges of the handle openings from pressing painfully into the fingers.

Still referring to FIGS. 3 and 4, the bottom end panel flap 24 is folded up against the dust flaps 46 and the glue strip 64 of the upper end panel flap 22 to complete the end panel formation. In addition to adhering the bottom end panel flap 24 to the glue strip 64, the other end panel flaps may also be adhered to each other in their areas of contact. It can be seen that the edges 54 of the dust flaps 48, which represent narrow portions of these dust flaps, are dimensioned so that they do not encroach into the area of the handle opening 60 in the end panel flap 58.

Figure 5:
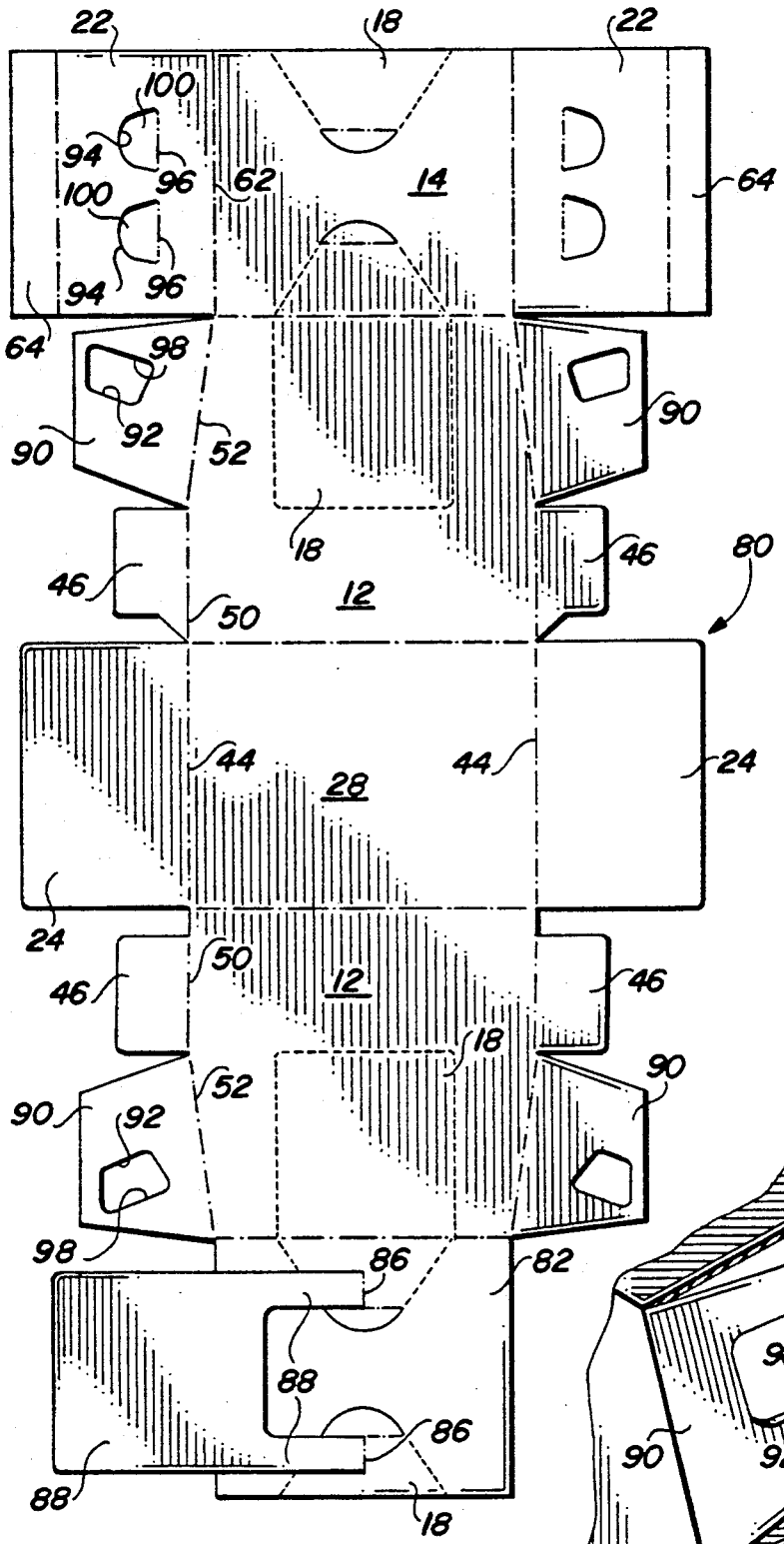
FIG. 5 is a plan view similar to that of FIG. 2, but showing a second embodiment.

Referring now to FIG. 5, a blank 80 illustrating a second embodiment of the invention is shown, wherein elements of the blank 80 which are similar to elements of the first embodiment have been assigned the same reference numerals. In this embodiment the carrier is the type that has a vertical divider depending from an inner top panel to physically separate the bottles on one side of the divider from those on the other side. Therefore, instead of providing an inner top panel section of the type provided in the first embodiment, an inner top panel section 82 is provided without end panel flaps connected to it. Divider panel 84 instead is connected to the inner top panel section by fold lines 86 at the ends of the divider legs 88.

Without end panel flaps connected to an inner top panel section, a handle opening must be provided in the carrier of the second embodiment by a different layer of material. This is accomplished by providing dust flaps 90 which are considerably wider than the corresponding dust flaps 48 in the first embodiment, and providing handle openings 92 in the dust flaps 90. The upper end panel flaps 22 are provided with spaced handle openings 94 arranged to overlie the openings 92 in a carrier formed from the blank. As in the first embodiment, the upper edges 96 of the openings 94 and the upper edges 98 of the openings 92 are arranged to be substantially aligned in the fully formed carrier. The openings 94 preferably would be provided with flaps 100 connected by fold lines to the upper edges 96.

Figure 7:
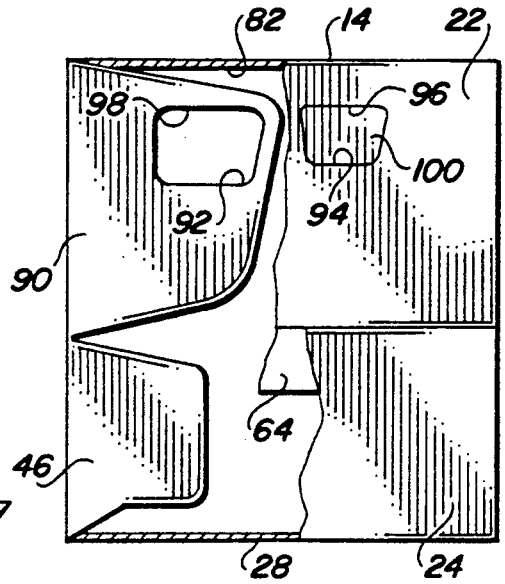
FIG. 7 is an end view similar to that of FIG. 4, but showing a carrier formed from the blank of FIG. 5.
Figure 6:
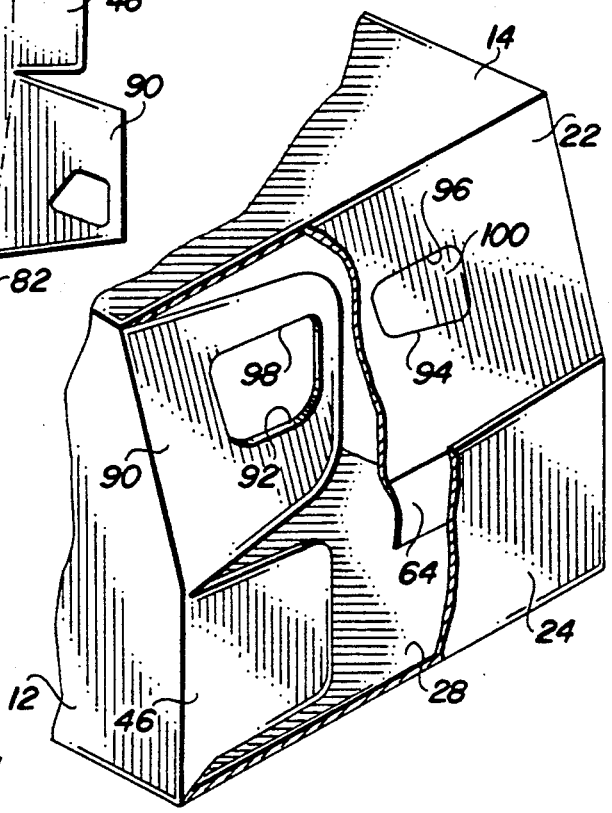
FIG. 6 is an enlarged partial pictorial view similar to that of FIG. 3, but showing a carrier formed from the blank of FIG. 5.

A sleeve is formed from the blank 80 in the same manner as the sleeve is formed from the blank 24 of the first embodiment, with the inner top panel section 82 being glued to the outer top panel section 14 after being folded into place. FIGS. 6 and 7, in which the articles in the carrier have also been omitted for purpose of clarity, depict an end panel of the carrier after the carrier has been formed, showing that the dust flaps 90 are quite wide, extending toward each other a distance almost equal to half the width of the carrier. This provides substantial support for the upper end panel flap 22 and provides for alignment of the upper edges 96 and 98 of the handle openings 94 and 92. The lower end panel flap 24 is adhered to the dust flaps 46 and the glue flap 64 of the upper end panel flap 22 in the same manner as in the embodiment.

It will be appreciated that the end panels of both embodiments enable handle openings to be provided in the upper end panel portion of a carrier, including the upper sloped portion of a carrier having sloped end panels. The handle openings are formed in overlying panel flaps, which provides for a handle opening of double thickness, and can be utilized in enclosed carriers either with or without bottle dividers. Preferably, when the second flap layer is provided by dust flaps, as in the second embodiment, the handle openings in the end panels comprise spaced openings through which spaced fingers of a user may extend.

It will now be apparent that the invention is not necessarily limited to all the specific details described in connection with the preferred embodiments, but that changes to certain specific features of the preferred embodiments which do not alter the overall basic function and concept of the invention may be made without departing from the spirit and scope of the invention, as defined in the claims.

What is claimed is:

1. A blank for forming an article carrier, comprising:

a central bottom panel section having side edges and end edges;

intermediate side panel sections connected to the side edges of the bottom panel section along score lines, each side panel section having side and end edges;

a first top panel section connected to the side edge of one of the side panel sections along a score line and a second top panel section connected to the side edge of the other side panel section along a score line, the first top panel section adapted to overlie the second top panel section in a carrier formed from the blank, the top panel sections having end edges;

first end panel flaps connected to the end edges of the first top panel section along score lines, each first end panel flap containing a handle opening therein;

second end panel flaps connected to the end edges of either the second top panel section or the intermediate side panel sections along score lines, the second end panel flaps containing a handle opening therein; and third end panel flaps connected to the end edges of the central bottom panel section;

the first end panel flaps being adapted to overlie the second end panel flaps and to overlap the third end panel flaps in a carrier formed from the blank so that the handle openings in the first end panel flaps overlie the handle openings in the second end panel flaps to enable a user to grasp the first and second handle openings in each end panel to lift the carrier.

2. The article carrier blank of claim 1, wherein each handle opening includes edges adapted to be the upper edges in a carrier formed from the blank, the upper edges in such a carrier being substantially aligned.

3. The article carrier blank of claim 1, wherein the second end panel flaps are connected to the end edges of the second top panel section.

4. The article carrier blank of claim 1, wherein the second end panel flaps are connected to the end edges of each of the intermediate side panel sections.

5. The article carrier blank of claim 1, wherein the side edges of the top panel sections are shorter than the side edges of the bottom panel section and the first end panel flaps form an obtuse angle with the top panel sections in a carrier formed from the blank.

* * * * *